US006354914B1

(12) United States Patent
Inaba et al.

(10) Patent No.: US 6,354,914 B1
(45) Date of Patent: Mar. 12, 2002

(54) WAFER POLISHING APPARATUS

(75) Inventors: Takao Inaba; Minoru Numoto; Kenji Sakai; Manabu Satoh, all of Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 0 days.

(21) Appl. No.: 09/432,268

(22) Filed: Nov. 2, 1999

Related U.S. Application Data

(62) Division of application No. 09/112,287, filed on Jul. 9, 1998.

(30) Foreign Application Priority Data

Jul. 11, 1997 (JP) ..... 9-186458
Jul. 18, 1997 (JP) ..... 9-194185
Oct. 31, 1997 (JP) ..... 9-300358

(51) Int. Cl.[7] ..... B24B 49/00
(52) U.S. Cl. ..... 451/41; 451/8; 451/41
(58) Field of Search ..... 451/5, 6, 41, 286

(56) References Cited

U.S. PATENT DOCUMENTS 4,712,334 A 12/1987 Ikezaki et al.
5,154,021 A 10/1992 Bombardier et al.
5,205,082 A 4/1993 Shendon et al.
5,609,516 A 3/1997 Courson et al.
5,762,539 A 6/1998 Nakashiba et al.
5,775,980 A * 7/1998 Sasaki et al.
5,797,789 A 8/1998 Tanaka et al.
5,803,799 A 9/1998 Volodarsky et al.
5,820,448 A * 10/1998 Shamouilian et al.
5,842,909 A * 12/1998 Sandhu et al.
5,882,243 A 3/1999 Das et al.
5,882,248 A * 3/1999 Wright et al.
5,916,009 A 6/1999 Izumi et al.

FOREIGN PATENT DOCUMENTS

JP 301169265 7/1991
JP 6-79618 3/1994
JP 8-229808 9/1996
JP 10-175161 6/1998

* cited by examiner

*Primary Examiner*—Joseph J. Hail, III
*Assistant Examiner*—Willie Berry, Jr.
(74) *Attorney, Agent, or Firm*—Nixon Peabody LLP; David S. Safran

(57) ABSTRACT

Sensors detect a stock removal of a wafer during polishing, and a CPU calculates the stock removal in accordance with information from the sensors. The CPU compares the actual stock removal detected by the sensors and a model stock removal stored in RAM, and determines timings for dressing and replacing said polishing pad in accordance with a difference between the actual stock removal and the model stock removal. The determination results are shown on a display.

8 Claims, 12 Drawing Sheets

WAFER POLISHING APPARATUS

This application is a divisional of application Ser. No. 09/112,287, filed Jul. 9, 1998.

BACKGROUND OF THE INVENTION

1. Field of the Invention

The present invention relates generally to a wafer polishing apparatus, and more particularly to a wafer polishing apparatus which is used with a chemical mechanical polishing (CMP) method.

2. Description of Related Art

According to a conventional wafer polishing apparatus used with the CMP method, it is difficult to directly detect the stock removal of the wafer during polishing, and thus, the stock removal of the wafer is controlled by managing a polishing time. For this reason, a dummy wafer is polished at regular intervals to find the stock removal in accordance with the polishing time, and this stock removal is compared with a model stock removal as a basis. If the difference between them is within the permissible level, the polishing continues, and if the difference exceeds the permissible level, the polishing is stopped to dress or replace the polishing pad.

The wafer polishing apparatus disclosed in Japanese Patent Provisional Publication Nos. 6-79618 (corresponds to U.S. Pat. No. 5,205,082) and 8-229808 adheres the wafer to a carrier, and applies a pressure force to the carrier to press the wafer against the polishing pad, thus polishing the wafer.

According to another conventional wafer polishing apparatus used with the CMP method, the air is supplied into a space between the carrier and the wafer, and the wafer is polished while it is pressed against the polishing pad. Since it is difficult to directly detect the stock removal of the wafer, the sensor detects the movement amount of the carrier with the body of the wafer polishing apparatus being the basis, and the output of the sensor is regarded as the stock removal of the wafer. Thus, the stock removal of the wafer is detected indirectly.

The conventional wafer polishing apparatus, however, cannot correctly detect an end point (a target value) of the stock removal because the stock removal of the wafer is controlled by managing the polishing time.

Since the conventional wafer polishing apparatus polishes the dummy wafer to determine the timings for dressing and replacing the polishing pad, the yield of the wafer is deteriorated.

Moreover, since the normal polishing is stopped while the dummy wafer is polished, the throughput is lowered.

According to the polishing apparatus disclosed in Japanese Patent Provisional Publication Nos. 6-79618 and 8-229808, the carrier presses the wafer directly against the polishing pad. If there are some foreign matters such as polishing dust between the carrier and the wafer, the pressure force cannot transmit uniformly to the entire surface of the wafer, and the entire surface of the wafer cannot be polished uniformly.

According to the conventional wafer polishing apparatus which detects the stock removal of the wafer with the body of the wafer polishing apparatus being a basis, the body is expanded by heat which is generated during the polishing. For this reason, if the movement amount of the carrier is detected, the stock removal of the wafer cannot be detected correctly. Thus, the polishing end point of the wafer cannot be detected correctly.

SUMMARY OF THE INVENTION

The present invention has been developed under the above-described circumstances, and has as its object the provision of a wafer polishing apparatus which is able to automatically determine the timings for dressing and replacing a polishing pad during normal polishing, detect a polishing end point of the wafer correctly, and polish the entire surface of the wafer uniformly and detect the end point of the stock removal.

To achieve the above-mentioned object, the present invention is directed to the wafer polishing apparatus which presses a wafer against a rotating polishing pad to polish the surface of the wafer, the wafer polishing apparatus comprising: stock removal detecting means for detecting a stock removal of the wafer; storage means for containing a model stock removal of the wafer in accordance with a polishing time; control means for comparing the stock removal detected by the stock removal detecting means and the model stock removal stored in the storage means, determining timings for dressing and replacing said polishing pad in accordance with a different between the stock removals, and outputting determination results; and display means for showing the determination results output from the control means.

To achieve the above-mentioned object, the present invention is directed to the wafer polishing apparatus which presses a wafer against a rotating polishing pad to polish the surface of the wafer, the wafer polishing apparatus comprising: a carrier for holding the wafer; first pressing means for pressing the carrier against the polishing pad; pressure air layer forming means for forming a pressure air layer between the carrier and the wafer and transmitting a pressure force from the first pressing means to the wafer through the pressure air layer; a retainer ring which encloses the periphery of said wafer and holding the wafer; a polished surface adjustment ring for enclosing the periphery of said wafer, the polished surface adjustment ring as well as the wafer coming into contact with the polishing pad; second pressing means for pressing said retainer ring and the polished surface adjustment ring against the polishing pad; stock removal detecting means for detecting a stock removal of the wafer; and control means for outputting a polishing end signal when the stock removal detected by the stock removal detecting means reaches a preset target value.

To achieve the above-mentioned object, the present invention is directed to the wafer polishing apparatus which presses a wafer against a rotating polishing pad to polish the surface of the wafer, the wafer polishing apparatus comprising: a carrier for holding the wafer; pressing means for pressing the carrier against the polishing pad; pressure air layer forming means for forming a pressure air layer between the carrier and the wafer and transmitting a pressure force from the first pressing means to the wafer through the pressure air layer; a retainer ring provided outside the carrier and pressed against the polishing pad, the retainer ring preventing the wafer from jumping out from the carrier; a pressing member provided outside the retainer ring and pressed against the polishing pad; and stock removal detecting means provided at the pressing member and provided with a contact which comes into contact with a reverse side of the wafer pressed against the polishing pad through the pressure air layer, stock removal detecting means detecting a stock removal of the wafer in accordance with a movement amount of the contact.

To achieve the above-mentioned object, the present invention is directed to the wafer polishing apparatus which presses a wafer against a rotating polishing pad to polish the surface of the wafer, the wafer polishing apparatus comprising: a carrier for holding the wafer; pressing means for pressing the carrier against the polishing pad; pressure air layer forming means for forming a pressure air layer between the carrier and the wafer and transmitting a pressure force from the first pressing means to the wafer through the pressure air layer; a retainer ring provided outside the carrier and pressed against the polishing pad, the retainer ring preventing the wafer from jumping out from the carrier; a pressing member provided outside the retainer ring and pressed against the polishing pad; and stock removal detecting means provided at the pressing member and detecting a relative displacement of the pressing member and the carrier, the stock removal detecting means detecting a stock removal of the wafer in accordance with the relative displacement.

According to the present invention, the stock removal detecting means detects the stock removal of the wafer during the polishing, and the control means compares the stock removal detected by the stock removal detecting means and the model stock removal stored in the storage means. The control means determines the timings for dressing and replacing the polishing pad in accordance with a difference with the stock removals. The determination results are shown on the display means. This makes it possible to automatically determine the timings for dressing and replacing the polishing pad during the normal polishing. According to the pressure air layer forming means forms a pressure air layer between the carrier and the wafer, and the pressure force is transmitted from the first pressing means to the wafer through the pressure air layer to press the wafer against the polishing pad. If there is some foreign matters such as polishing dust between the carrier and the wafer, the pressure force can uniformly be transmitted from the first pressing means to the entire surface of the wafer. Thus, the entire surface of the wafer can be polished uniformly.

According to the present invention, there is provided the polished surface adjustment ring which comes into contact with the polishing pad with the wafer, and the second pressing means adjusts the pressure force of the polished surface adjustment ring which presses the polishing pad to thereby prevent the polishing pad from rising at the periphery of the wafer and make uniform the pressure which the polishing pad applies to the wafer.

According to the present invention, the stock removal detecting means detects the stock removal of the wafer during the polishing, and the control means outputs the polishing end signal to finish polishing when the stock removal detected by the stock removal detecting means reaches the preset target value. Thus, the end point of the stock removal can be detected correctly.

According to the present invention, the stock removal detecting means is provided at the pressing member which is pressed against the polishing pad with the wafer, and the contact of the stock removal detecting means comes into contact with the reverse side of the wafer to directly detect the stock removal of the wafer. Since the stock removal of the wafer is detected with the polishing pad being the basis, the polishing end point of the wafer can be detected correctly. In this case, the pressing member is prevented from being polished or deformed in order to serve as a position basis member (a zero point member) for the contact.

According to the present invention, the pressing member is arranged outside the retainer ring in order to prevent the wafer from colliding with the pressing member during the polishing. For this reason, the pressing member can be prevented from vibrating due to the collision with the wafer. Thus, the stock removal of the wafer can be detected correctly.

According to the invention, the stock removal detecting means is provided at the pressing member which is pressed against the polishing pad with the wafer, and the stock removal detecting means detects the relative displacement of the pressing member and the carrier to thereby detect the stock removal of the wafer. Since the stock removal of the wafer is detected with the polishing pad being the basis, the polishing end point of the wafer can be detected correctly.

According to the present invention, the stock removal detecting means is provided at such a position as to detect the stock removal at the center of the wafer. The vibration is the least at the center of the wafer during the polishing. According to the present invention which detects the stock removal at the center of the wafer, the stock removal of the wafer can be detected correctly.

According to the present invention, the stock removal detecting means is the differential transformer which is provided with the core and the bobbin. Thus, the stock removal of the wafer can be detected correctly.

According to the present invention, the stock removal detecting means is the light wave interference apparatus. Thus, the stock removal of the wafer can be detected correctly.

According to the present invention, the pressing member is made of material which is difficult to expand thermally, and the contact surface of the pressing member is coated with diamond or is made of ceramic. This prevents the pressing member from expanding thermally and being polished by the polishing pad during polishing. Since the stock removal detecting means attached to the pressing member detects the stock removal of the wafer with the polishing pad being the basis, the stock removal of the wafer can be detected correctly.

According to the present invention, the polished surface adjustment ring is arranged outside the retainer ring, and the polished surface adjustment ring is pressed against the polishing pad to flatten the polishing pad. The pressing member is pressed against the flattened polishing pad. This prevents the pressing member from vibrating vertically due to the unevenness of the polishing pad. The stock removal detecting means attached to the pressing member is able to correctly detect the stock removal of the wafer.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be explained in further detail by way of example with reference to the accompanying drawings.

Figure 1:
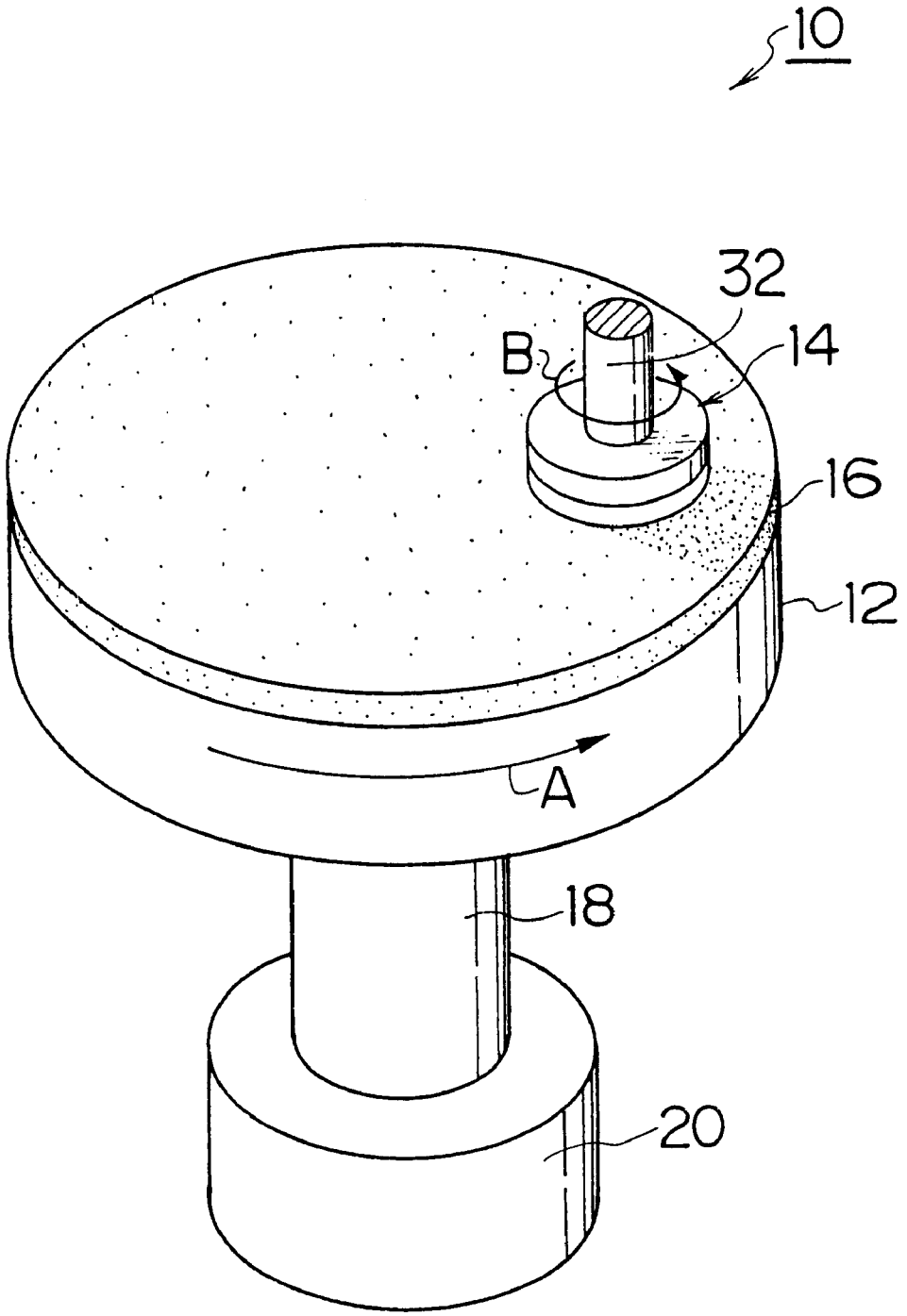
FIG. 1 is a view illustrating the entire structure of the wafer polishing apparatus according to the present invention.

FIG. 1 shows the entire structure of a wafer polishing apparatus according to the present invention.

As shown in FIG. 1, the wafer polishing apparatus 10 is provided with a turn table 12 and a wafer holding head 14. The turn table 12 is disc-shaped, and polishing pad 16 is attached on the top of the turn table 12. A spindle 18 connects to the bottom of the turn table 12 and an output shaft (not shown) of a motor 20. Driving the motor 20 rotates the turn table 12 in the direction indicated by an arrow A, and slurry is supplied onto the polishing pad 16 of the rotating turn table 12 through a nozzle (not shown). A lifting apparatus (not shown) is capable of moving the wafer holding head 14 vertically. The wafer holding head 14 is moved up when a wafer subject for polishing is set in the wafer holding head 14, and the wafer holding head 14 is moved down and pressed against the polishing pad 16 when the wafer is polished.

Figure 2:
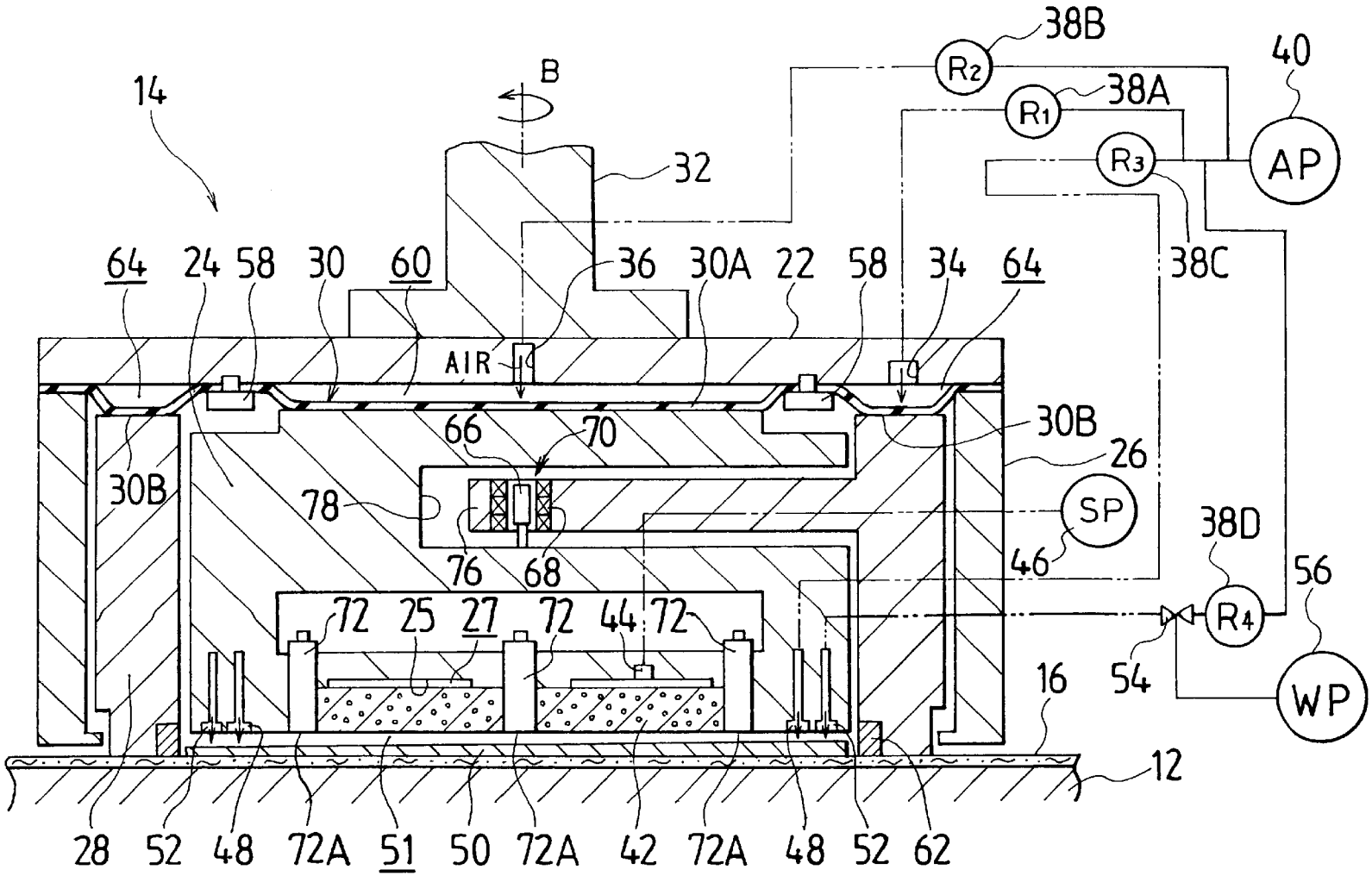
FIG. 2 is a longitudinal sectional view illustrating the first embodiment of the wafer holding head applied to the wafer polishing apparatus in FIG. 1.

FIG. 2 is a longitudinal sectional view of the wafer holding head 14. The wafer holding head 14 is comprised mainly of a head body 22, a carrier 24, a guide ring 26, a polished surface adjustment ring 28, and a rubber sheet 30. The head body 22 is disc-shaped, and a motor (not shown) connected to a rotary shaft 32 rotates the head body 22 in the direction indicated by an arrow B. Air supply passages 34, 36 are formed in the head body 22. The air supply passage 34 extends to the outside of the wafer holding head 14 as indicated by long and short alternate lines in FIG. 2. The air supply passage 34 connects to an air pump (AP) 40 via a regulator (R) 38A. The air supply passage 36 connects to the air pump 40 via a regulator 38B.

The carrier 24 is shaped substantially like a column, and it is coaxially arranged below the head body 22. A concave 25 is formed at the bottom of the carrier 24, and the concave 25 contains a permeable porous board 42. An air chamber 27 is formed over the porous board 42, and the air chamber 27 communicates with an air suction passage 44 formed in the carrier 24. The air suction passage 44 extends to the outside of the wafer holding head 14 as indicated by long and short alternate lines in FIG. 2, and it connects to a suction pump (SP) 46. Driving the suction pump 46 causes the porous board 42 to absorb the wafer 50 to the bottom thereof. The porous board 42 has a number of vent holes therein, and it is, for example, a sintered body of a ceramic material.

A number of air supply passages 48 are formed in the carrier 24 (FIG. 2 shows only two air supply passages), and jetting holes of the air supply passages 48 are formed in the bottom of the carrier 24. The air supply passages 48 extend to the outside of the wafer holding head 14 as indicated by long and short alternate lines in FIG. 2, and the air supply passages 48 connect to the air pump 40 via a regulator 38C. The compressed air supplied from the air pump 40 via the regulator 38C is jetted to an air chamber 51 between the porous board 42 and the wafer 50. This forms a pressure air layer in the air chamber 51, and, therefore, the pressure force of the carrier 24 is transmitted to the wafer 50 through the pressure air layer. The wafer 50 is pressed against the polishing pad 16. If there is some dust between the carrier 24 and the wafer 50 when the carrier 24 presses the wafer 50 directly to the polishing pad 16, the pressure force of the carrier 24 cannot be transmitted uniformly to the entire surface of the wafer 50. Pressing the wafer 50 via the pressure air layer makes it possible to transmit the pressure force of the carrier 24 to the entire surface of the wafer 50 even if there is some dust between the carrier 24 and the wafer 50.

The wafer holding head 14 controls the pressure force against the carrier 24 to move the carrier 24 vertically, and controls the polishing pressure of the wafer 50 (the force which presses the wafer 50 is pressed against the polishing pad 16). For this reason, the control of the polishing pressure is easier than the control of the polishing pressure of the wafer 50 by controlling the pressure of the pressure air layer. In other words, the wafer holding head 14 is able to control the polishing pressure of the wafer 50 by controlling the vertical position of the carrier 24. The air, which is jetted through the air supply passages 48, 48, . . . is, discharged through a vent (not shown) which is formed in the polished surface adjustment ring 28.

A number of air/water supply passages 52 (FIG. 2 shows only two of them) are formed in the carrier 24, and their jetting holes are formed in the bottom of the carrier 24. The air/water supply passages 52 extend to the outside of the wafer holding head 14 as indicated by long and short alternate lines in FIG. 2, and each passage 52 is divided into two branches with use of a valve 54. One branch connects to the air pump 40 through a regulator 38D, and the other branch connects to a water pump (WP) 56. If the valve 54 opens the branch at the air pump 40 side and closes the branch at the water pump 56 side, the compressed air is supplied from the air pump 40 to the air chamber 51 through the air/water supply passages 52. If the valve 54 is switched to close the branch at the air pump 40 side and opens the branch at the water pump 56 side, then the water is supplied from the water pump 56 to the air chamber 51 through the air/water supply passages 52.

A rubber sheet 30 is arranged between the carrier 24 and the head body 22. The rubber sheet 30 is a disc with a uniform thickness. The rubber sheet is fixed to the bottom of the head body 22 with support of an annular stopper 58. The rubber sheet is divided into a central part 30A and an outer peripheral part 30B with the stopper 58 being a boundary. The central part 30A of the rubber sheet 30 presses the carrier 24, and the outer peripheral part 30B presses the polished surface adjustment ring 28.

A space 60 is formed below the head body 22, and the space 50 is sealed by the central part 30A of the rubber sheet 30 and the stopper 58. The air supply passage 36 communicates with the space 60. When the compressed air is supplied into the space 60 through the air supply passage 36, the central part 30A of the rubber sheet 30 is elastically deformed under the air pressure to press the top of the carrier 24. Thus, the wafer 50 is pressed against the polishing pad 16. Adjusting the air pressure with the regulator 38B controls the pressure force of the wafer 50.

The cylindrical guide ring 26 is coaxially formed below the head body 22. The guide ring 26 is fixed to the head body 22 through the rubber sheet 30. The polished surface adjustment ring 28 is arranged between the guide ring 26 and the carrier 24. A retainer ring 62 is attached to the inner periphery of the lower part of the polished surface adjusting ring 28, and the retainer ring 62 prevents the wafer 50 from jumping out.

An annular space 64 is formed at the lower outer periphery of the head body 22, and the space 64 is sealed by the head body 22, the outer peripheral part 30B of the rubber sheet 30, or the like. The air supply passage 34 communicates with the space 64. When the compressed air is supplied into the space 64 through the air passage 34, the outer peripheral part 30B of the rubber sheet 30 is elastically deformed under the air pressure to press the annular top of the polished surface adjusting ring 28. This presses the annular bottom of the polished surface adjusting ring 28 against the abrasive cloth 16. Adjusting the air pressure controls the pressure force of the polished surface adjustment ring 28.

The wafer holding head 14 is provided with a stock removal detector which detects a stock removal in polishing. The stock removal detector consists of a sensor 70, which is composed of a core 66 and a bobbin 68, and non-contact sensors 72. A CPU (see FIG. 3) 74 is provided at the outside of the wafer holding head 14, and the CPU 74 calculates a detection signal which is output from the sensors 70, 72.

The bobbin 68 of the sensor 70 is attached to the end of the arm 76 which extends toward a rotary shaft of the wafer holding head 14 from the inner surface of the polished surface adjustment ring 28. The core 66 of the sensor 70 is provided at such a position that a central axis of the core 66 is coaxial with the rotary shaft of the wafer holding head 14. The sensor 70 detects a vertical movement amount of the carrier 24 with respect to the polishing pad 16. A groove 78 is formed in the carrier 24,and the arm 76 is inserted into the groove 78.

Although the sensor 70 is able to roughly detect the stock removal of the wafer 50, the sensors 72 corrects a detected value detected by the sensor 70 with detected values detected by the sensors 72, thereby acquiring the stock removal of the wafer 50 correctly.

The sensor 72 is a non-contact sensor such as an eddy-current sensor, and a detecting surface 72A of the sensor 72 is flush with the bottom of the porous board 42. The detecting surface 72 detects the distance to the top of the wafer 50 to thereby detect a variable in thickness of the pressure air layer (the air chamber 51).

Figure 3:
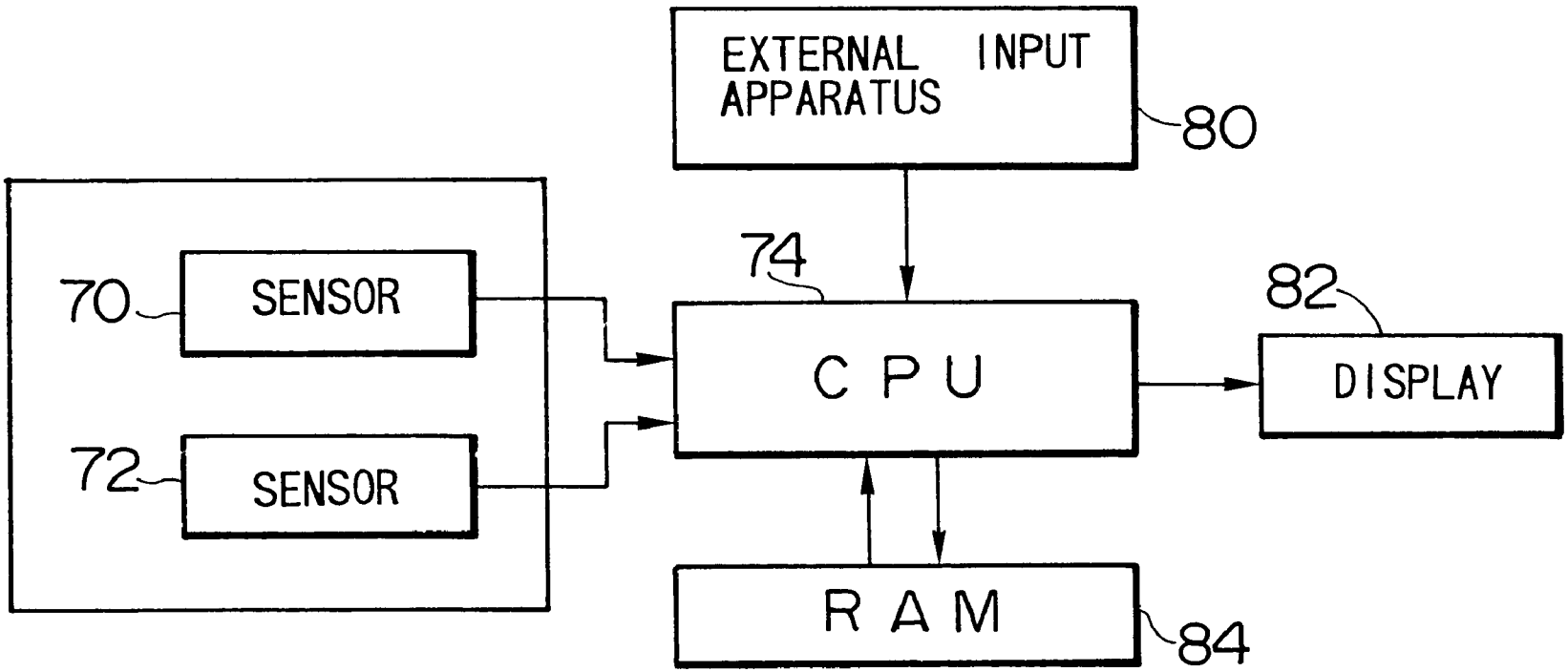
FIG. 3 is a block diagram illustrating the control system in the wafer polishing apparatus in FIG. 1.

The CPU 74 in FIG. 3 adds the variable in thickness of the pressure air layer detected by the sensors 72 to the movement amount of the carrier 24 detected by the sensor 70 to calculate the stock removal of the wafer 50. In other words, the CPU 74 calculates the stock removal of the wafer 50 from the variable and the movement amount with respect to a previously-stored reference value. For instance, if the movement amount detected by the sensor 70 is T1 and the average of the variables detected by the sensors 72 is T2, the stock removal of the wafer 50 is calculated in accordance with the equation T1+T2. If the movement amount detected by the sensor 70 is T1 and the average of the variables detected by the sensors 72 is 0, the stock removal of the wafer 50 is calculated in accordance with the equation T1–0. If the movement amount detected by the sensor 70 is T1 and the average of variables detected by the sensors 72 is –T2, the stock removal of the wafer 50 is calculated in accordance with the equation: T1–T2. According to this embodiment, since the stock removal is calculated from the variable and the movement amount detected by the sensors 70, 72, it is possible to detect the stock removal of the wafer 50 correctly.

In the wafer holding head 14, the sensor 70 is arranged coaxially with the rotary shaft of the wafer holding head 14. A position where the sensor 70 is arranged is equivalent to a position on the central axis of the wafer 50 during the polishing, and thus, the sensor 70 detects the stock removal at the center of the wafer 50. During polishing, the center of the wafer 50 vibrates less than any other parts of the wafer 50. Thus, the sensor 70 can detect the stock removal of the wafer 50 correctly.

In FIG. 3, the CPU 74 connects to an external input apparatus 80 such as a keyboard. From the external input apparatus 80, the CPU 74 receives information indicting a model stock removal of the wafer in accordance with the polishing time.

Figure 4:
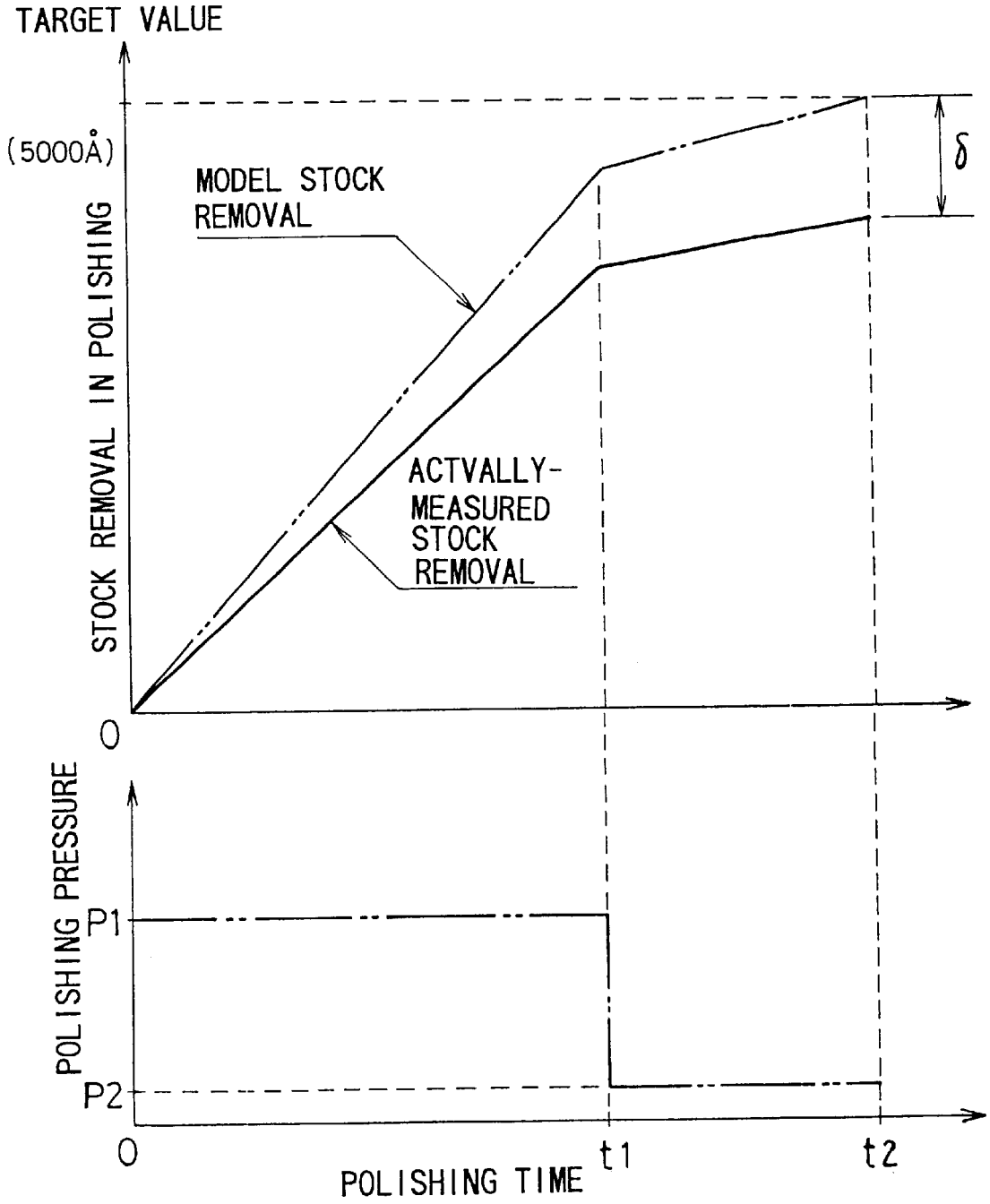
FIG. 4 is a graph in which a model stock removal in polishing is compared with an actually-measured stock removal in polishing, and a graph showing a relation between the polishing pressure and the pressing time.

FIG. 4 shows the model stock removal of the wafer and an actually-measured stock removal in accordance with the polishing time. The vertical axis of a graph in FIG. 4 shows the stock removal in polishing and the polishing pressure, and the horizontal axis thereof shows the polishing time.

The model stock removal (a target value in polishing: 5000 Å) indicated by long and short alternate lines in FIG. 4 is set in such a way that the polishing pressure within the polishing time is input with the external input apparatus 80. Specifically, the polishing pressure from the start of polishing to t1 is set at P1, and the polishing pressure from t1 to the polishing ending time t2 is set at P2. If the abrasive pressure is set in this manner, the stock removal per unit time is large from the start of polishing to t1, and the stock removal per unit time is small from t1 to t2.

In FIG. 4, the graph shows the actually-measured stock removal with a solid line when the wafer is polished in accordance with the polishing pressure set by the external input apparatus 80 (the abrasive pressure for acquiring the model stock removal). The CPU 74 determines the timings for dressing and replacing the polishing pad 16 with reference to a difference $\lambda$ between the actually-measured stock removal and the model stock removal. Specifically, the CPU 74 has a first threshold level for determining the dressing timing and a second threshold level for determining the replacing timing. The CPU 74 determines whether to continue polishing, dress or replace the polishing pad 16. The result is shown on a display 82 in FIG. 3.

The abrasive pressure set by the external input apparatus 80 as well as the actual stock removal are stored in RAM 84. Further, the RAM 84 contains the previously-obtained actual stock removal and historical data of the actual stock removal. The CPU 74 reads the previously-obtained actual stock removal from the RAM 84, and compares with this stock removal and the actual stock removal which has just been obtained so as to find a variable in stock removal. In accordance with the variable, the CPU 74 determines whether to continue polishing, dress or replace the polishing pad 16.

A description will be given of the operation of the wafer holding head 14 of the wafer polishing apparatus 10 which is constructed in the above-mentioned manner with reference to FIG. 2.

After the wafer holding head 14 is moved up, the suction pump 46 is run to absorb the wafer 50 subject for polishing to the porous board 42.

Then, the wafer holding head 14 is moved down and stopped at a position where the bottom of the polished surface adjustment ring 28 of the wafer holding head 14 contacts the polishing pad 16. Then, the suction pump 46 is stopped to release the absorption of the wafer 50, and the wafer 50 is placed on the polishing pad 16.

Then, the air pump 40 is run to supply the compressed air into the air chamber 51 through the air supply passage 48, thereby forming a pressure air layer in the air chamber 51 to transmit the pressure force of the carrier 24 to the entire surface of the wafer 50.

Then, the compressed air is supplied from the air pump 40 to the space 60 through the air supply passage 36, and the central part 30A of the rubber sheet 30 is elastically deformed under the inner air pressure and presses the carrier 24. This causes the pressure force of the central part 30A of the rubber sheet 30 to transmit from the carrier 24 to the wafer 50 through the pressure air layer, and the wafer 50 is pressed against the polishing pad 16. The regulator 38B adjusts the air pressure to thereby control the inner air pressure at desired air pressure, so that the pressure force of the wafer 50 against the polishing pad 16 can be constant.

Then, the compressed air is supplied from the air pump 40 into the space 64 through the air supply passage 34, and the outer peripheral part 30B of the rubber sheet 30 is elastically deformed under the inner air pressure to press the polished surface adjustment ring 28 against the polishing pad 16. The regulator 38A adjusts the air pressure so that the inner air pressure can be set at a desired pressure, and the pressure force of the polished surface adjustment ring 28 against the polishing pad 16 is maintained constant.

The CPU 74 receives the polishing pressure from the external input apparatus 80 in FIG. 3 so as to obtain the model stock removal. Then, the turn table 12 and the wafer holding head 14 are rotated to start polishing the wafer 50. The external input apparatus 80 can set the polishing pressure just before polishing or in advance.

After the first wafer 50 is polished, the CPU 74 calculates a difference δ between the actual stock removal of the wafer 50 and the model stock removal in accordance with the polishing time. The CPU 74 compares the previously-stored two threshold levels and the calculated difference δ, and accordingly determines whether to continue polishing, dress or replace the polishing pad 16. The result is shown on the display 82. If the display 82 shows "continue polishing", an operator continues running the wafer polishing. apparatus 10, which polishes the next wafer 50. If the display 82 shows "dress", the wafer polishing apparatus 10 is halted, and a dressing grinding wheel is pressed against the polishing pad 16 to dress the polishing pad 16 for a preset period of time. Then, the wafer polishing apparatus 10 is reactivated to continue polishing the wafer 50. If the display 82 shows "replace", the wafer polishing apparatus 10 is halted, and the polishing pad 16 is replaced by a new one. Then, the wafer polishing apparatus 10 is reactivated to continue polishing the wafer 50.

As stated above, the actual stock removal of the wafer 50 and the preset model stock removal are compared, and the timings for dressing and replacing the polishing pad 16 are determined in accordance with the difference δ. The timings for dressing and replacing the polishing pad 16 can be determined automatically during the normal polishing.

Figure 5:
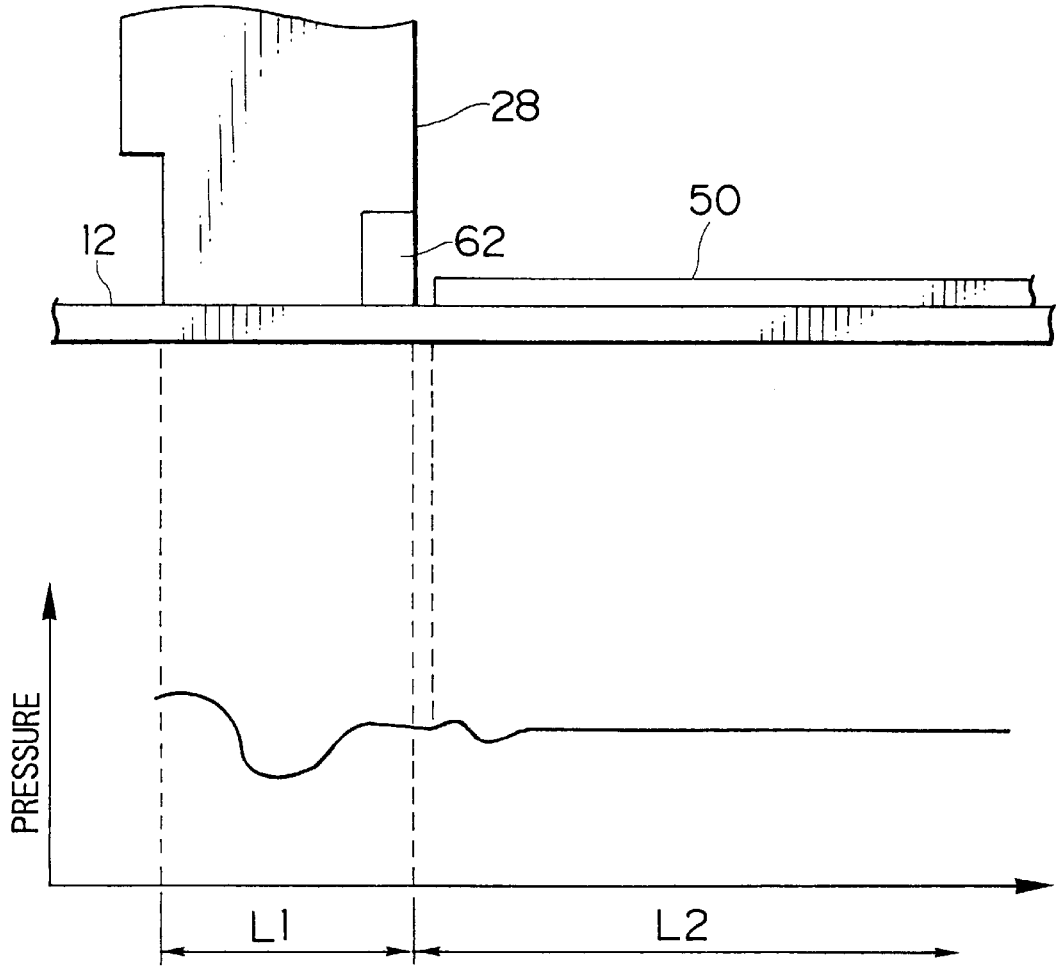
FIG. 5 is a view of assistance in explaining the pressure which the polishing pad applies to the wafer.

FIG. 5 is a view of assistance in explaining the pressure which the polishing pad 16 applies to wafer 50 when the polished surface adjustment ring 28 is pressed against the polishing pad 16 under a preset pressure force.

As shown in FIG. 5, the pressure of the polishing pad 16, which is generated by pressing the polished surface adjustment ring 28 against the polishing pad 16, reaches the maximum at the outer periphery of the polished surface adjustment ring 28 in an area L1 which the polished surface adjustment ring 28 contacts. The pressure of the polishing pad 16 slightly changes at the edge of the wafer 50 in the area L2 which the wafer 50 contacts, whereas the pressure at the other parts of the wafer 50 is constant. The use of the polished surface adjustment ring 28 prevents the polishing pad 16 from rising at the periphery of the wafer 50. This makes uniform the pressure which the polishing pad 16 applies to the wafer 50, and thus, the entire surface of the wafer 50 can be uniformly polished.

The thickness of the wafer 50 is known in advance, and it is possible to detect a relation between a position where the work surface of the wafer 50 contacts the polishing pad 16 and a position where the polished surface adjustment ring 28 contacts the polishing pad 16. Thus, the pressure force of the polished surface adjustment ring 28 can correctly be adjusted.

According to the wafer holding head 14 using the polished surface adjustment ring 28, the external input apparatus 80 in FIG. 3 sets the polishing pressure, and the pressure force of the polished surface adjustment ring 28 is set in a manner to prevent the polishing pad 16 from rising at the periphery of the wafer 50. Then, the turn table 12 and the wafer holding head 14 are rotated to start polishing the wafer 50.

Figure 6:
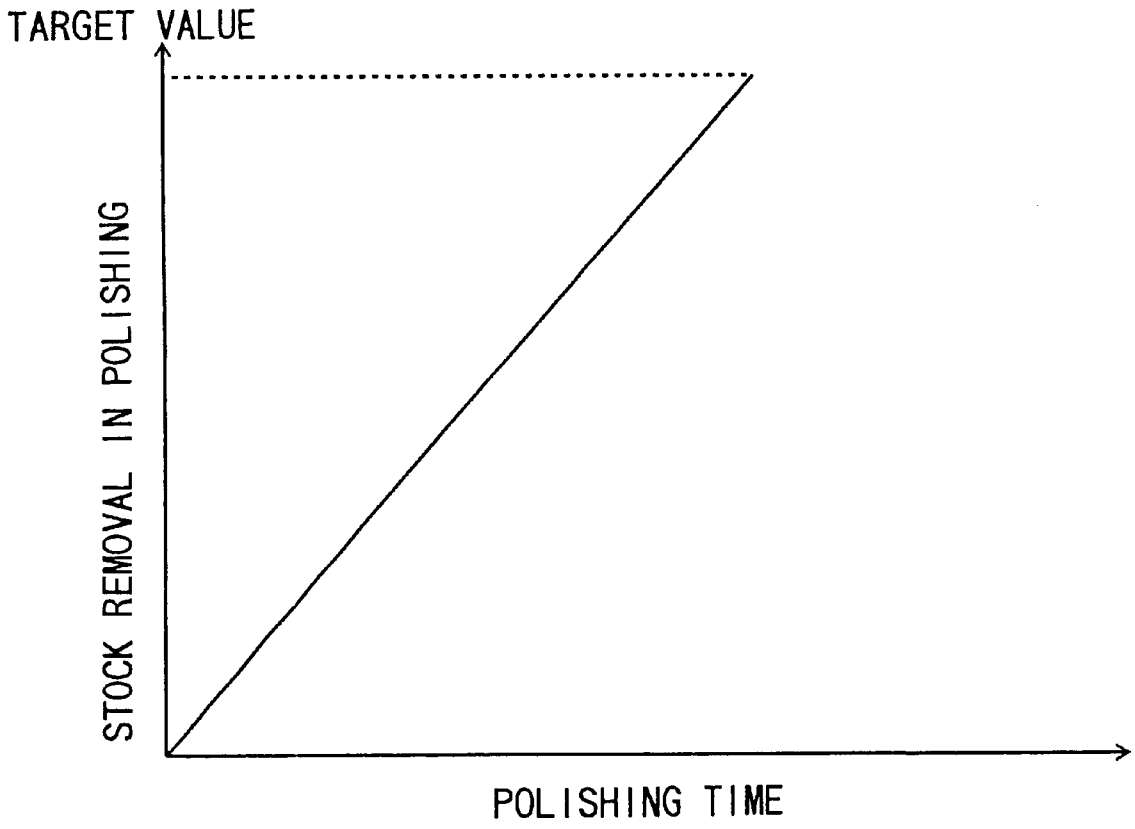
FIG. 6 is a graph showing a relation between the stock removal and the polishing time.

The CPU 74 calculates the stock removal of the wafer 50 during polishing in accordance with detection signals which are output from the sensors 70, 72. When the stock removal of the wafer 50, which is calculated by the CPU 74, reaches a preset target value in FIG. 6, the CPU 74 outputs a polishing ending signal to stop the wafer polishing apparatus 10. This completes the polishing of the first wafer 50. The above-described steps are repeated to polish the subsequent wafers 50. FIG. 6 is a graph showing the end point of the stock removal in polishing with respect to the polishing time.

As stated above, the stock removal of the wafer is detected, and the polishing ending signal is output when the detected stock removal reaches a preset polishing target value. Thus, the polishing end point of the wafer can be detected correctly.

Moreover, the pressure air layer is formed between the carrier 24 and the wafer 50 to polish the wafer 50, and thus, the entire surface of the wafer 50 can be polished uniformly even if there are some foreign matters such as polishing dust between the carrier 24 and the wafer 50.

The polishing apparatus of Japanese Patent Provisional Publication No. 9-57613 detects the polishing end point of the wafer with use of a displacement detecting apparatus. The polishing apparatus of No. 9-57613 polishes the wafer which is held on a holding table directly, whereas the pressure air layer is formed between the carrier 24 and the wafer 50 in the polishing apparatus of the present invention. For this reason, these two polishing apparatus are completely different in structure. When the wafer 50 is polished through the pressure air layer as is the case with the present invention, the polishing end point of the wafer 50 can be detected correctly by using the sensor 70 which detects the displacement of the carrier 24 and the sensor 72 which detects the thickness of the pressure air layer.

Figure 7:
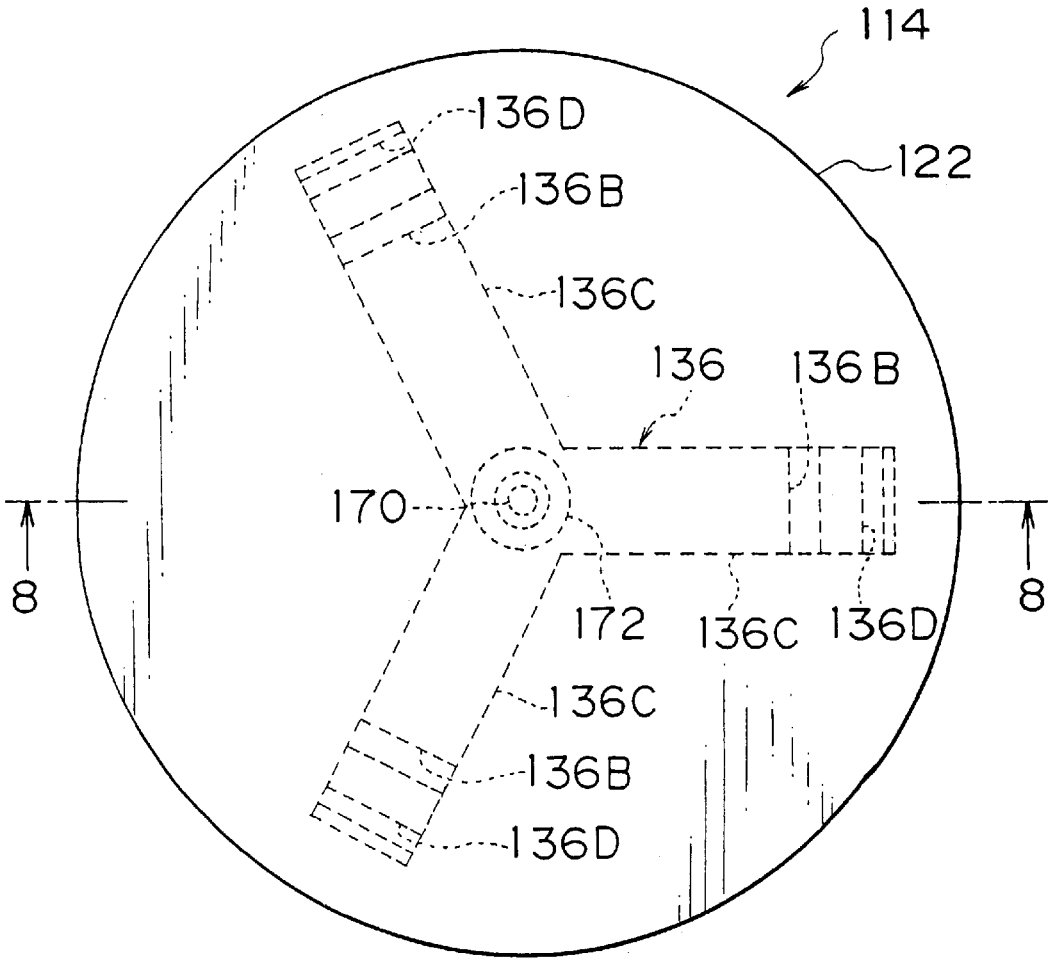
FIG. 7 is a plan view illustrating the second embodiment of the wafer holding head.
Figure 8:
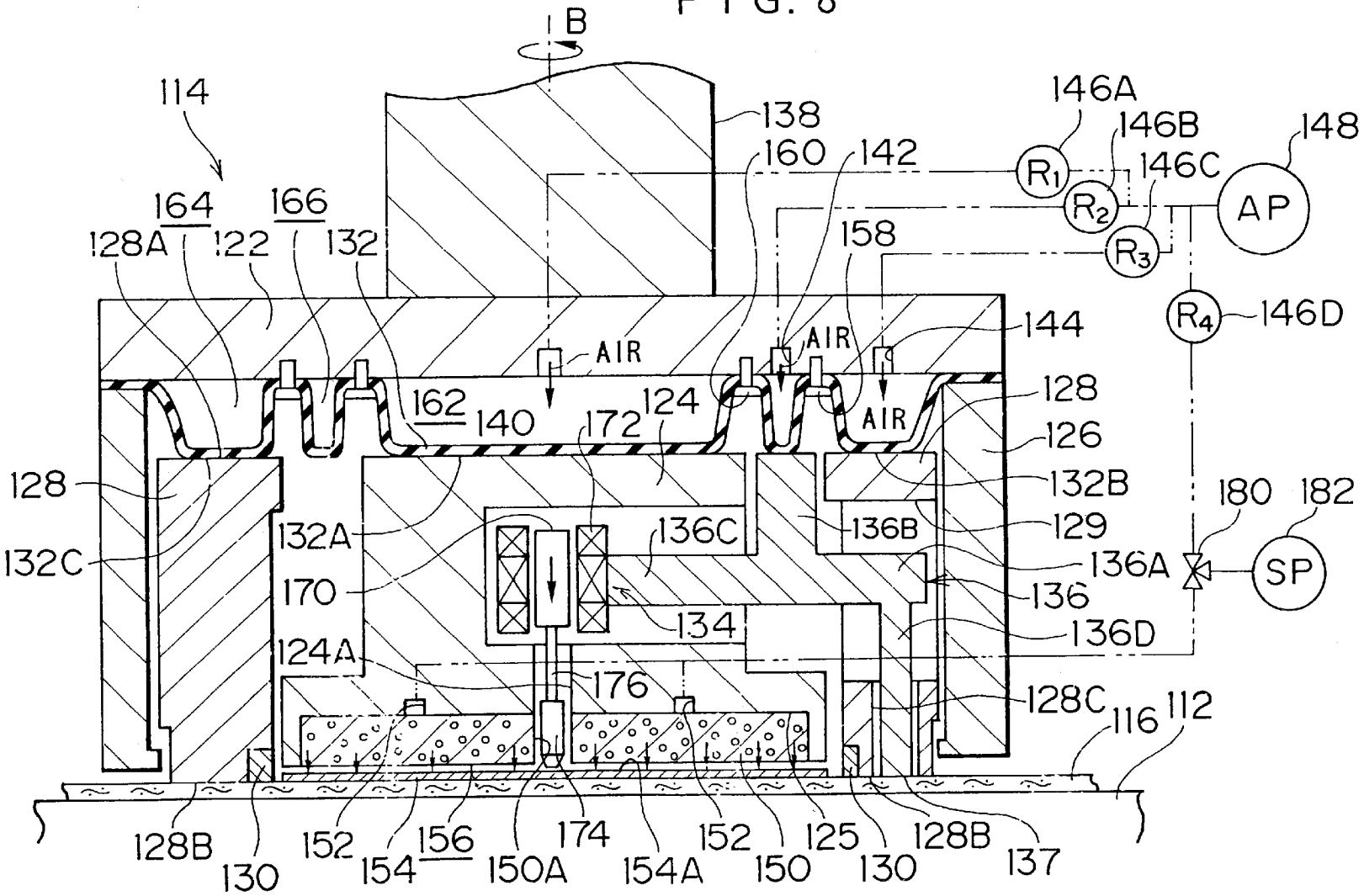
FIG. 8 is a longitudinal sectional view of the wafer holding head along line 8—8 in FIG. 7.

FIG. 7 is a plan view showing the second embodiment of a wafer holding head 114. FIG. 8 is a longitudinal sectional view taken along line 8—8 of FIG. 7.

The wafer holding head 114 of FIG. 8 comprises a head body 122, a carrier 124, a guide ring 126, a polished surface adjustment ring 128, a retainer ring 130, a rubber sheet 132, a differential transformer 134, and a pressing member 136.

The head body 122 is disc-shaped, and a rotary shaft 238 connects to the top of the head body 122. The head body 122 is rotated in the direction of an arrow B by a motor (not shown) which connects to the rotary shaft 138. Air supply passages 140, 142,. 144 are formed in the head body 122. The air supply passage 140 extends to the outside of the wafer holding head 114 as indicated by long and two short alternate lines in FIG. 8. The air supply passage 140 connects to an air pump (AP) 148 via a regulator (R) 146A. The air supply passages 142, 144 also extend to the outside of the holding head 114. The air supply passage 142 connects to an air pump 148 via a regulator 146B, and the air supply passage 144 connects to the air pump 148 via a regulator 146C.

The carrier 124 is shaped like a column, and it is coaxially arranged below the head body 122. A concave part 25 is formed at the bottom of the carrier 124, and the concave part 125 contains a permeable porous board 150. The porous board 150 communicates with air passages 152 which are formed in the carrier 124. As indicated by long and short alternate lines, the air passages 152 extend to the outside of the holding head 114, and they connect to the air pump 148 via the regulator 146D. Driving the air pump 148 causes the air pump 148 to jet the compressed air into a space 156 between the porous board 150 and the wafer 154 through the air passages 152 and the porous board 150. This forms a pressure air layer in the space 156, and the pressure force of the carrier 124 is transmitted to the wafer 154 through the pressure air layer. The wafer 154 is polished in a state of being pressed against the polishing pad 116 under the pressure force transmitted through the pressure air layer. The air passages 152 connect to a suction pump (SP) 182 through a switching valve 180. Switching the switching valve 180 and driving the suction pump 182 causes the wafer 154 to be absorbed to the porous board 150. The porous board 150 has a number of vent holes therein, and it is made of, for example, a sintered body of ceramic material.

On the other hand, a disc-shaped rubber sheet 132 with uniform thickness is arranged between the head body 122 and the carrier 124. The rubber sheet 132 is fixed to the bottom of the head body 122 by large and small annular stoppers 158, 160. The rubber sheet 132 is divided into a central part 132A and an intermediate part 132B with the stopper 160 being a boundary, and is divided into the intermediate part 132B and an outer peripheral part 132C with the stoppers 158 being a boundary. The rubber sheet 132 is divided into three by the stoppers 158, 160. The central part 132A functions as an air bag which presses the carrier 124, the intermediate part 132B functions as an air bag which presses the pressing member 136, and the outer peripheral part 132C functions as an air bag which presses the polished surface adjustment ring 128.

The air supply passage 140 communicates with the air bag 162 which is specified by the central part 132A of the rubber sheet 132. When the compressed air is supplied to the air bag 162 through the air supply passage 140, the central part 132A of the rubber sheet 132 is elastically deformed under the air pressure to press the top of the carrier 124. This presses the wafer against the polishing pad 116. Adjusting the air pressure by the regulator 146A controls the pressure force (the abrasive pressure) applied to the wafer 154.

The guide ring 126 is shaped like a cylinder, and it is coaxially arranged below the head body 122. The guide ring 126 is fixed to the head body 122 via the rubber sheet 132. A polished surface adjustment ring 128 is arranged between the guide ring 126 and the carrier 124. A retainer ring 130 is attached to the inner periphery of the lower part of the polished surface adjustment ring 128, and the retainer ring 130 prevents the wafer 154 from jumping out.

An annular air bag 164 is formed at the lower peripheral part of the head body 122, and the annular air bag 164 is specified by the outer peripheral part 132C of the rubber sheet 132 and the stopper 158 The air supply passage 144 communicates with the air bag 164. The supply of the compressed air to the air bag 164 through the air supply passage 144 elastically deforms the outer peripheral part 132C of the rubber sheet 132 by the air pressure to thereby press an annular top surface 128A of the polished surface adjustment ring 128. An annular bottom surface 128B of the polished surface adjustment ring 128 is pressed against the polishing pad 116. Adjusting the air pressure by the regulator 146C controls the pressure force of the polished surface adjustment ring 128.

The pressing member 136 is arranged between the carrier 124 and the polished surface adjustment ring 128. The pressing member 136 consists of a body 136A, heads 136B, support arms 136C, and legs 136D. The three heads 136B, the three support arms 136 and the three legs 136D of the pressing member 136 are formed as a unit at regular intervals as indicated by dotted lines in FIG. 7. The number of legs 136D is not restricted to three, but it may be cylindrical in a manner to cover the circumference of the carrier 124.

The body 136A of the pressing member 136 in FIG. 8 is arranged in an opening 129 which is formed in the polished surface adjustment ring 128. The head 136B of the pressing member 136 is integrated with the body 136A, and the head 136B is arranged in a gap between the carrier 124 and the polished surface adjustment ring 128.

An annular air bag 166 is formed above the head 136B, and the annular air bag 126 is specified by the intermediate part 132B of the rubber sheet 132 and the stoppers 158, 160. The air supply passage 142 communicates with the air bag 166. The supply of the compressed air to the air bag 166 through the air supply passage 142 elastically deforms the intermediate part 132B of the rubber sheet 132 under the air pressure to thereby press the head 136B of the pressing member 136. This causes a bottom 137 of the leg 136D of the pressing member 136 to be pressed against the polishing pad 116. Adjusting the air pressure by the regulator 146B controls the pressure force of the pressing member 136. The leg 136D is arranged in a hole 28C formed in the polished surface adjustment ring 128. Since the surface of the polishing pad 116 which the bottom 137 of the leg 136D contacts is flattened by the polished surface adjustment ring, the pressing member 136 is prevented from vibrating vertically due to the unevenness of the polishing pad 116.

The base material of the pressing member 138 is umber, whose coefficient of thermal expansion is so small as to prevent the thermal expansion caused by the polishing temperature. The bottom 137, which is pressed against the polishing pad 116, is coated with diamond in order to prevent it from being polished by the polishing pad 116. The bottom 137 may also be made of a material (e.g. ceramic) which is smaller in the machining rate than the wafer 154.

On the other hand, the differential transformer 134 is provided at the end of the support arm 136C of the pressing member 136, and the differential transformer 134 detects the stock removal of the wafer 154. The differential transformer 134 consists of a core 170, a bobbin 172, and a contact 174. The bobbin 172 connects to an arithmetic unit (not shown), which calculates the stock removal of the wafer 154 in accordance with the vertical movement amount of the core 170 with respect to the bobbin 172. The bobbin 172 is fixed to the end of the support arm 136C of the pressing member 136, and the core 170 is arranged in the bobbin 172 in such a way as to move vertically. A rod 176 is fixed at the bottom of the core 170 coaxially with the core 70, and the contact 174 is fixed to the bottom end of the rod 176. The rod 176 is arranged in a hole 124A formed in the carrier 124. The contact 174 is arranged in a hole 150A formed in the porous board 150. The contact 174 is pressed directly against the reverse side 154A of the wafer 154 during polishing. The carrier 124 is preferably provided with a stopper member which prevents the rod 176 from falling out, and the hole 124A is preferably provided with a packing which prevents the air, which is supplied to the space 156, from leaking.

A description will be given of the operation of the wafer holding head 114 which is constructed in the above-mentioned manner.

The holding head 124 is moved up, and the suction pump 182 is driven to cause the wafer 154 subject for polishing to be absorbed to the porous board 150.

Then, the wafer holding head 114 is moved down and stopped at a position where the contact surface of the polished surface adjustment ring 128 comes into contact with the polishing pad 116. The suction pump 182 is stopped to release the absorption of the wafer 154, and the wafer 154 is placed on the polishing pad 116. At this time, the contact 174 of the differential transformer 134 moves downward with the wafer 154, and comes into contact with the reverse size 154A of the wafer 154 as shown in FIG. 8. The contact position is automatically set as a zero point in the arithmetic unit.

The switching valve 180 is switched to the air pump 148 side, and then the air pump 148 is driven to supply the compressed air to the space 156 through the air passage 152 to thereby form a pressure air layer in the space 156. The control of the regulator 146D adjusts the supply of the compressed air and sets the pressure P of the pressure air layer. Specifically, the pressure P ($P<W/A$) is set in such a manner as to be higher than the pressure which is found by dividing the pressure force W by which the rubber sheet 132 presses the wafer 154 against the polishing pad 116, by the area A of the wafer 154. This prevents the pressure air layer 154 from being crushed by the carrier 124.

The compressed air is supplied from the pump 148 to the air bag 162 through the air passage 140, and the central part 132A of the rubber sheet 132 is elastically deformed by the inner air pressure to thereby press the carrier 124. The wafer 154 is pressed against the polishing pad 116 via the pressure air layer. The adjustment of the air pressure by the regulator 146A controls the inner air pressure at a desired pressure and keeps the pressure force of the wafer 154 against the polishing pad 116 constant.

At the same time, the compressed air is supplied from the pump 148 to the air bag 164 through the air supply passage 144, and the outer peripheral part 132C of the rubber sheet 132 is elastically deformed under the inner air pressure to thereby press the polished surface adjustment ring 128. The bottoms of the polished surface adjustment ring 128 and the retainer ring 130 are pressed against the polishing pad 116. The compressed air is supplied from the pump 148 to the air bag 166 through the air supply passage 142. The intermediate part 132B of the rubber sheet 132 is elastically deformed under the inner air pressure to thereby press the pressing member 136, and the bottom 137 of the pressing member 136 is pressed against the polishing pad 116. Then, the turn table 112 and the wafer holding head 114 are rotated to start polishing the wafer 154.

The arithmetic unit calculates the stock removal of the wafer 154 during polishing in accordance with the descending amount of the contact 174 of the differential transformer 134, that is, the descending amount of the core 170, in the state wherein the contact 174 is in contact with the reverse side 154A of the wafer 154.

When the stock removal calculated by the arithmetic unit reaches a preset polishing end point, the wafer polishing apparatus is stopped to finish polishing the wafer 154. Thus, the polishing of the first wafer 154 is completed. The above-described steps are repeated to polish the subsequent wafer 154.

According to the wafer holding head 114 of the second embodiment, the differential transformer 134 is provided at the pressing member 136 which is pressed with the wafer 154, and the contact 174 of the differential transformer 134 comes into contact with the reverse side 154A of the wafer 154 to directly detect the stock removal of the wafer 154. For this reason, the polishing end point of the wafer 154 can be detected more correctly.

According to the wafer holding head 114, the pressing member 136 is arranged outside the retainer ring 130, and this prevents the wafer 154 from colliding with the pressing member 136 during polishing. It is therefore possible to prevent the pressing member 136 from vibrating due to the collision with the wafer 154. For this reason, the stock removal of the wafer can be detected correctly.

The base material of the leg 136D of the pressing member 136, to which the bobbin 172 is attached, is umber whose coefficient of thermal expansion is so small as to prevent the thermal expansion caused by polishing temperature. The bottom 137, which is pressed against the polishing pad 116, is coated with diamond in order to prevent the bobbin 172 from moving from a reference position (the position of a zero point). In other words, the differential transformer 134 detects the stock removal of the wafer 154 with the surface of the polishing pad 16 being a reference. It is possible to correctly calculate the stock removal of the wafer 154 only by detecting the descending amount of the core 170. To the contrary, the conventional apparatus, which detects the stock removal of the wafer with the body thereof being a reference, cannot correctly detect the stock removal of the wafer due to the thermal expansion of the body.

Since the bottom 137 of the pressing member 136 is pressed against the polishing pad 116 which is flattened by the polished surface adjustment ring 128, the pressing member 136 is prevented from vibrating vertically due to the unevenness of the polishing pad 116. Thus, by the use of the differential transformer 134, the stock removal of the wafer 154 can be detected more correctly.

In this embodiment, the differential transformer 134 is used for the stock removal detecting means of the wafer 154, but it is also possible to use any other means which comes into contact with the reverse side 154A of the wafer 154 to detect the stock removal of the wafer 154.

Figure 9:
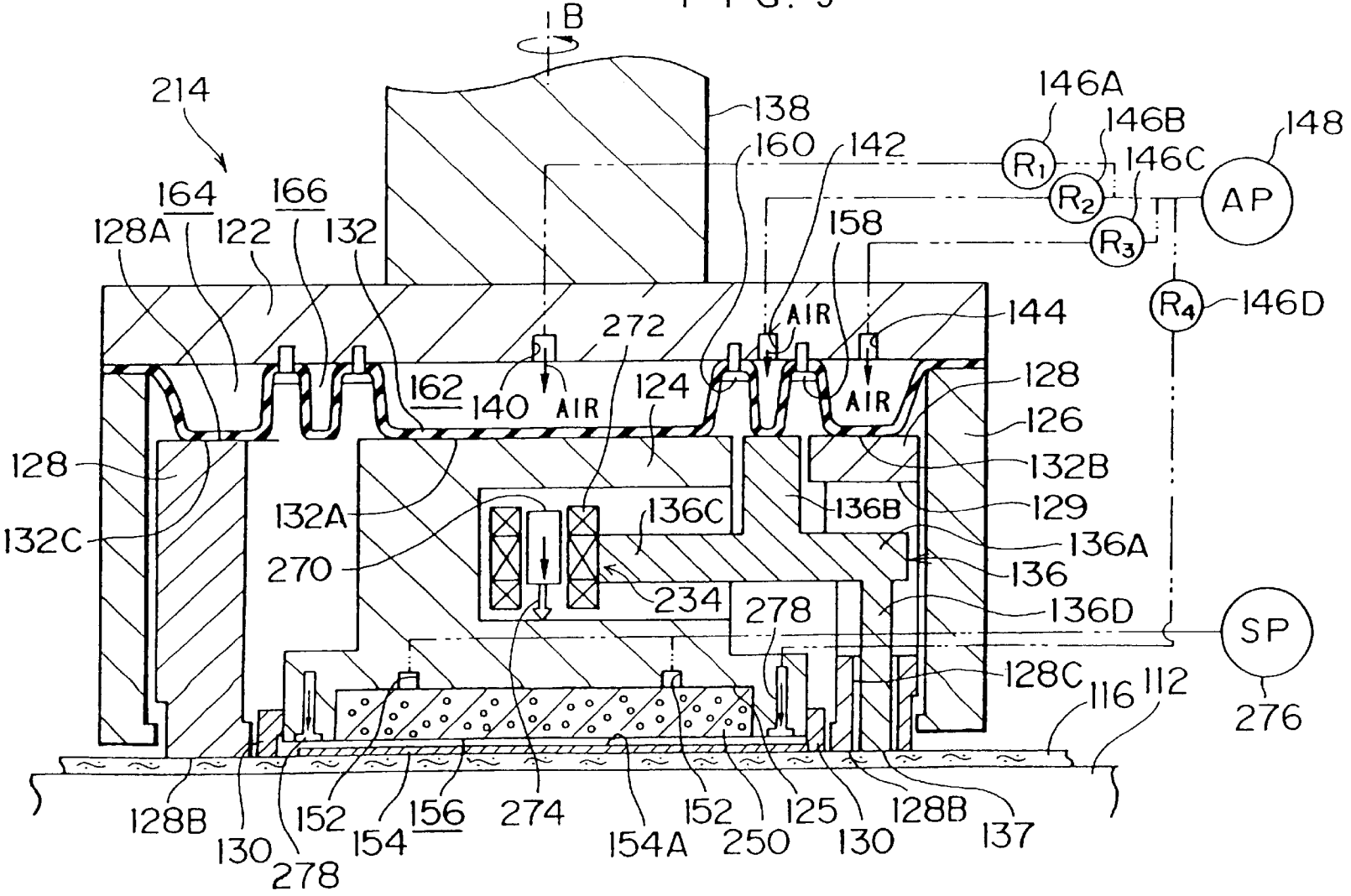
FIG. 9 is a longitudinal sectional view illustrating the third embodiment of the wafer holding head.

FIG. 9 is a longitudinal sectional view illustrating the third embodiment of the wafer holding head 214. Parts common or similar to those of the wafer holding head 114 according to the second embodiment in FIG. 8 will be designated by the same reference numerals, and they will not be explained.

A description will now be given of the difference between the wafer holding head 214 in FIG. 9 and the wafer holding head 114 in FIG. 8.

The first difference lies in the structure of the differential transformer which detects the stock removal of the wafer 154. In the differential transformer 134 of the wafer holding head 114 in FIG. 8, the contact 174 comes into contact with the reverse side 154A of the wafer 154. To the contrary, in the differential transformer 234 of the wafer holding head 214 in FIG. 9, the contact 274 comes into contact with the carrier 124. Thus, if the contact 274 comes into contact with the carrier 124, the differential transformer can correctly detect the stock removal of the wafer 154. In other words, the thickness of the pressure air layer in the space 156 is almost uniform.

As is the case with the differential transformer 134, the differential transformer 234 detects the stock removal of the wafer 154 with the polishing pad 116 being a reference, and thus, the differential transformer 134 can correctly detect the stock removal of the wafer 154. In FIG. 9, reference numeral 270 is a core, and 272 is a bobbin.

The second difference lies in the functions of the porous board. The porous board 150 of the wafer holding head 114 in FIG. 8 absorbs the wafer and jets the air, whereas the porous board 250 of the wafer holding head 214 in FIG. 9 merely absorbs the wafer. In the wafer holding head 214 in FIG. 9, a plurality of air jetting holes 278 are formed in the bottom of the carrier 124 in such a way as to enclose the porous board 250. The air jetting holes 278 connect to the air pump 148 through the regulator 146D. The porous board 250 connects to a suction pump 276.

According to the wafer holding head 214 in FIG. 9, driving the suction pump 276 causes the porous board 250 to absorb and hold the wafer 154, and driving the air pump 148 and jetting the air from the air jetting holes 278 forms the pressure air layer in the space 156.

Figure 10:
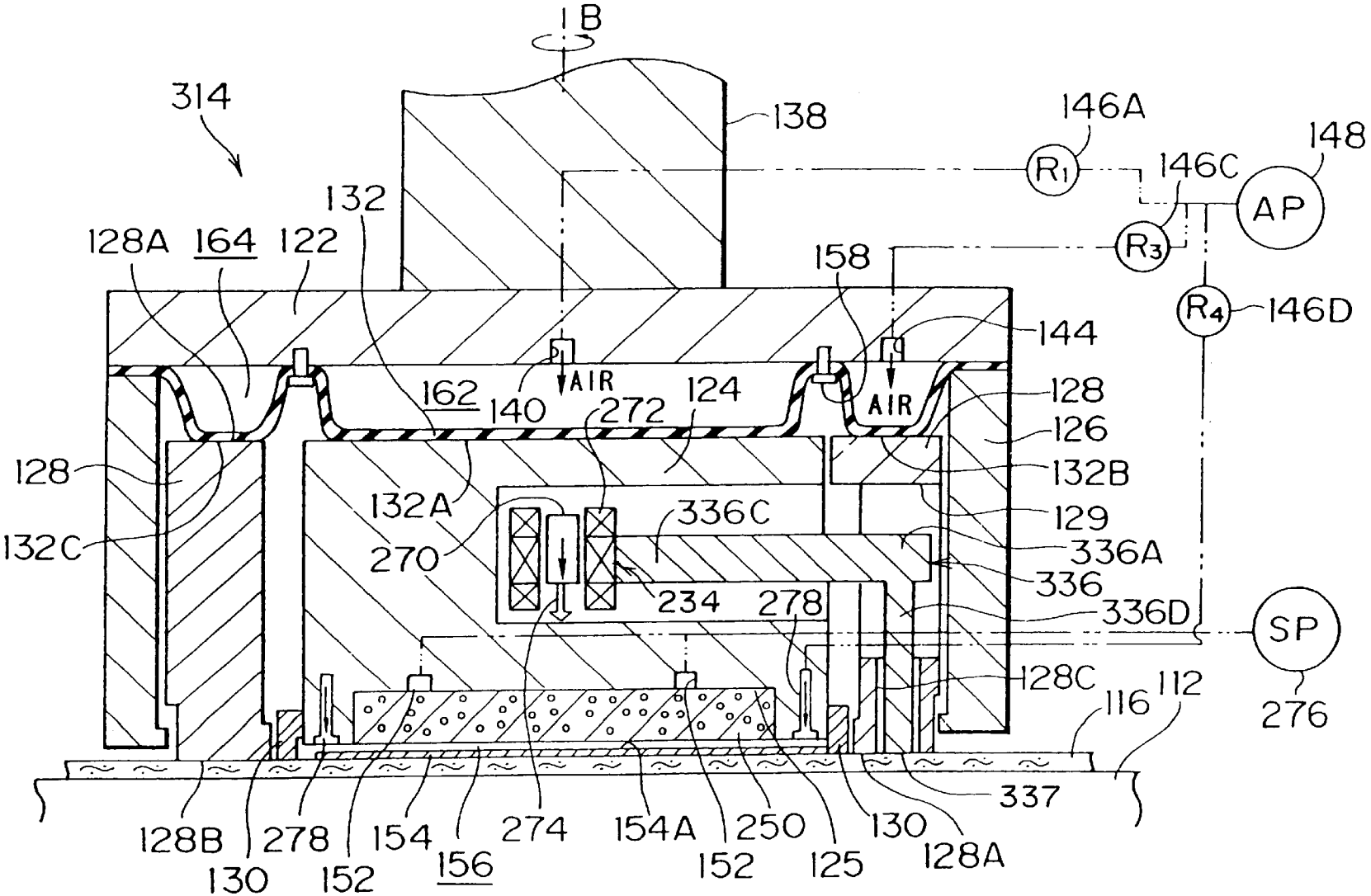
FIG. 10 is a longitudinal sectional view illustrating the fourth embodiment of the wafer holding head.

FIG. 10 is a longitudinal sectional view illustrating the fourth embodiment of a wafer holding head 314. Parts commo or similar to those of the wafer holding head 214 according to the third embodiment shown in FIG. 9 are designated by the same reference numerals, and they will not be explained.

The wafer holding head 314 in FIG. 10 is different from the wafer holding head 214 in FIG. 9 in the structure of the pressing member. A head part 136B is formed on the pressing member 136 of the wafer holding head 214 in FIG. 9, and the air bag 166 presses the head part 136B to press the bottom 137 of the pressing member 136 against the polishing pad 112.

On the other hand, the pressing member 336 of the wafer holding head 314 in FIG. 10 is not provided with a head part, and the bottom 337 of the pressing member 336 is pressed against the polishing pad 116 by the deadweight of the pressing member 336.

The pressing member 336 in FIG. 10 is applied if the pressure force of the pressing member 336 is unnecessary since the pressing member 336 is heavy or the polishing pad 112 is hard. In FIG. 10, reference numeral 336A is the body of the pressing member 336, reference numeral 336C is a support arm of the pressing member 336, and reference numeral 336D is a leg of the pressing member 336.

Figure 11:
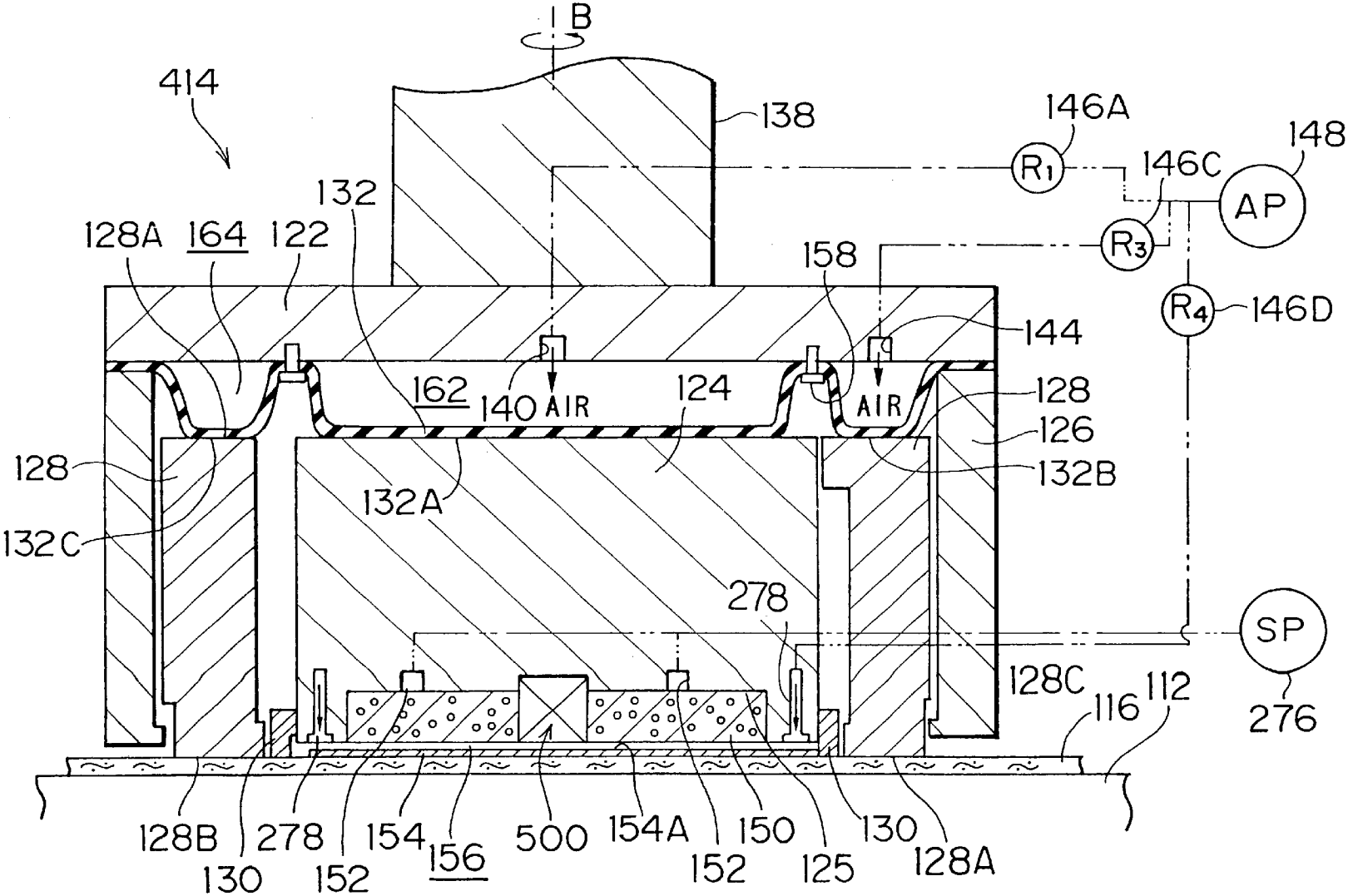
FIG. 11 is a longitudinal sectional view illustrating the fifth embodiment of the wafer holding head.

FIG. 11 is a longitudinal sectional view illustrating the fifth embodiment of a wafer holding head 414. Parts common or similar to those of the wafer holding head 314 according to the fourth embodiment in FIG. 10 will be denoted by the same reference numerals, and they will not be explained.

The wafer holding head 414 in FIG. 11 is different from the wafer holding head 314 in FIG. 10 in that the wafer stock removal detecting apparatus of the wafer holding head 314 in FIG. 10 is the differential transformer 234 whereas the wafer stock removal detecting apparatus of the wafer holding head 414 in FIG. 11 is a light wave interference apparatus 500.

Figure 12:
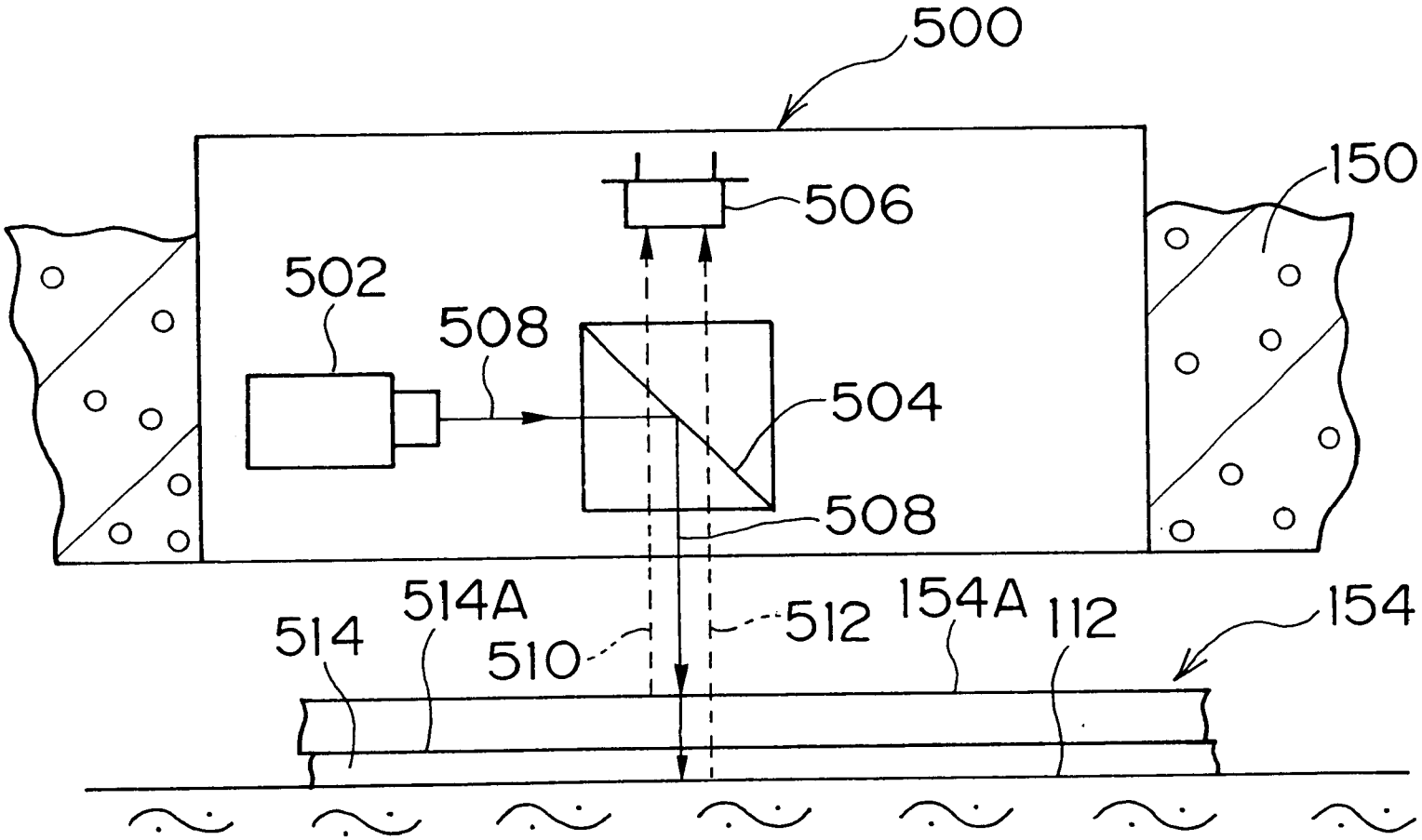
FIG. 12 is a view illustrating the structure of an infrared interference apparatus provided in the wafer holding head in FIG. 11.

FIG. 12 shows the structure of the light wave interference apparatus 500. The light wave interference apparatus 500 is an infrared interference apparatus, and it is comprised mainly of a light source 502 which emits infrared light, a beam splitter 504, and a photodiode 506. The beam splitter 504 reflects the infrared light 508 from the light source 502 downward to the wafer 154. The reflected infrared light 508 is reflected on the reverse side 154A of the wafer 154 and the polishing pad 116. The reflected light (reference light) 510 reflected on the reverse side 154A of the wafer 154 is transmitted to the beam splitter 504. The reflected light 512 reflected on the polishing pad 116 is transmitted to the beam splitter 504, and the reflected light 512 overlaps the reflected light 510 to thereby form interference fringes. A counter circuit (not shown) counts the number of interference fringes after the photodiode 506 converts them into electric signals photoelectrically. A calculation circuit (not shown) detects the displacement of the polishing pad 116, that is, the stock removal of the wafer 154 in accordance with the number of interference fringes.

If the light wave interference apparatus 500 is used for the wafer stock removal detecting apparatus, the stock removal of the wafer 154 can be detected correctly. The light wave interference apparatus 500 may be applied to the wafer holding heads 14, 114, 214, 314 according to the first, second, third and fourth embodiments.

In this embodiment, the infrared interference apparatus is used for the light wave interference apparatus 500, but a laser interference apparatus may be used instead. In the light wave interference apparatus 500 of this embodiment, the reflected light 510 reflected on the reverse side 154A of the wafer 154 is the reference light, but the reflected light reflected on a unpolished surface 514A of a silicon film oxide 514 may also be the reference light.

As set forth hereinabove, according to the present invention, the timings for dressing and replacing the polishing pad are determined in accordance with the difference between the wafer stock removal detected by the stock removal detecting means and the model stock removal stored in the storage means, and the determination results are shown on the display. Thus, the timings for dressing and replacing the polishing pad can be determined automatically during the normal polishing.

According to the wafer polishing apparatus of the present invention, the pressure air layer is formed between the carrier and the wafer, and the wafer is polished through the pressure air layer. For this reason, the entire surface of the wafer can be polished uniformly even if there are some foreign matters such as polishing dust between the carrier and the wafer.

According to the wafer polishing apparatus of the present invention, the stock removal detecting means is provided at the pressing member which is pressed against the polishing pad with the wafer, and the contact of the stock removal detecting means comes into contact with the reverse side of the wafer to directly detect the stock removal of the wafer. Thus, it is possible to correctly detect the polishing end point of the wafer.

According to the wafer polishing apparatus of the present invention, the stock removal detecting means is provided at the pressing member which is pressed against the polishing pad with the wafer, and the stock removal detecting means detects the relative displacement of the pressing member and the carrier to thereby detect the stock removal of the wafer. Thus, it is possible to correctly detect the polishing end point of the wafer.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing apparatus comprising:

a turn table for supporting and rotating a polishing pad having a polishing surface;

a wafer holding head comprising: a carrier for holding a wafer and pressing the wafer against said polishing surface under a predetermined pressure; and a polishing surface adjustment ring extending beyond said carrier toward said polishing surface for pressing against said polishing surface, said polishing surface adjustment ring completely surrounding an outer periphery of the wafer; wherein said wafer holding head presses a face of the wafer against said polishing surface while rotating; and a light wave interference apparatus for detecting a movement amount of said carrier on a central axis of the wafer with respect to said polishing surface adjusting ring.

2. The wafer polishing apparatus set forth in claim 1, wherein said light wave interference apparatus comprises a light source for emitting light, a beam splitter for reflecting light waves emitted from said light source downward to the wafer and the polishing pad, and a photodiode for converting interference signals from light waves reflected off the surface of the wafer and the polishing surface of the polishing pad into electronic signals.

3. The wafer polishing apparatus set forth in claim 2, wherein said light source emits infrared light.

4. The wafer polishing apparatus set forth in claim 2, wherein said light source emits laser light.

5. A wafer polishing apparatus comprising:

a turn table for supporting and rotating a polishing pad having a polishing surface;

a wafer holding head comprising: a carrier for holding a wafer and pressing the wafer against said polishing surface under a predetermined pressure; and a polishing surface adjustment ring extending beyond said carrier toward said polishing surface for pressing against said polishing surface, said polishing surface adjustment ring completely surrounding an outer periphery of the wafer; wherein said wafer holding head presses a face of the wafer against said polishing surface while rotating;

a pressing member for pressing against said polishing surface under a predetermined pressure; and a light wave interference apparatus for detecting a movement amount of one of an opposing face of the wafer and said carrier on a central axis of the wafer with respect to said pressing member.

6. The wafer polishing apparatus set forth in claim 5, wherein said light wave interference apparatus comprises a light source for emitting light, a beam splitter for reflecting light waves emitted from said light source downward to the wafer and the polishing pad, and a photodiode for converting interference signals from light waves reflected off the surface of the wafer and the polishing surface of the polishing pad into electronic signals.

7. The wafer polishing apparatus set forth in claim 6, wherein said light source emits infrared light.

8. The wafer polishing apparatus set forth in claim 6, wherein said light source emits laser light.

* * * * *